US011419397B2

(12) United States Patent
Almond et al.

(10) Patent No.: US 11,419,397 B2
(45) Date of Patent: Aug. 23, 2022

(54) PUSH-UP CONTACT LENS BLISTER PACKAGE

(71) Applicant: CooperVision International Limited, Fareham (GB)

(72) Inventors: Sarah Almond, Southampton (GB); Carlos Ortiz, Pittsford, NY (US); Gary Hunt, Bristol (GB); Mike Nelson, Bristol (GB); Russell Beard, Bristol (GB); Thomas Harkin, Bristol (GB); Pauline Gavelle, Toulouse (FR)

(73) Assignee: COOPERVISION INTERNATIONAL LIMITED, Fareham (GB)

( * ) Notice: Subject to any disclaimer, the term of this patent is extended or adjusted under 35 U.S.C. 154(b) by 0 days.

(21) Appl. No.: 16/737,939

(22) Filed: Jan. 9, 2020

(65) Prior Publication Data

US 2020/0229562 A1 Jul. 23, 2020

Related U.S. Application Data

(60) Provisional application No. 62/795,302, filed on Jan. 22, 2019.

(51) Int. Cl.
*A45C 11/00* (2006.01)
*B65D 75/36* (2006.01)

(52) U.S. Cl.
CPC ..... *A45C 11/005* (2013.01); *B65D 75/366* (2013.01)

(58) Field of Classification Search
CPC ..... A45C 11/005; A45C 2011/006; B65D 75/366; B65D 75/36
(Continued)

(56) References Cited

U.S. PATENT DOCUMENTS 4,691,820 A 9/1987 Martinez
D299,085 S 12/1988 Martinez
(Continued)

FOREIGN PATENT DOCUMENTS

AU 739045 B2 10/2001
EP 0734958 A1 10/1996
(Continued)

OTHER PUBLICATIONS

International Search Report and Written Opinion issued in corresponding International Patent Application No. PCT/GB2020/050112 dated Apr. 3, 2020 (10 pages).
(Continued)

*Primary Examiner* — Javier A Pagan
(74) *Attorney, Agent, or Firm* — Kilyk & Bowersox, P.L.L.C.

(57) ABSTRACT

A blister package for a contact lens is provided and has a body and a seal. The body includes a handle and a deformable bowl. The seal seals the deformable bowl at a bowl top opening. The handle includes a lateral portion and an end portion. The end portion curves downwardly to a distal end that terminates at a plane. The bowl is recessed from a top surface of the body and the outer bottom surface of the bowl is arranged substantially on the same plane as the distal end of the handle. The design provides leverage in holding the blister package while a user deforms and inverts the bowl into a dome, presenting a contact lens on top of the dome in position for direct transfer to a person's finger or for application directly on an eye without the need for any finger contact.

14 Claims, 2 Drawing Sheets

(58) Field of Classification Search
USPC ..... 206/5.1
See application file for complete search history.

(56) References Cited

U.S. PATENT DOCUMENTS

| | | | | |
|---|---|---|---|---|
| D305,478 | S | 1/1990 | Lahm et al. | |
| 5,069,494 | A | 12/1991 | Reinson et al. | |
| 5,409,104 | A | 4/1995 | Lovell | |
| 5,456,351 | A | 10/1995 | Johnson | |
| 5,609,246 | A | 3/1997 | Borghorst et al. | |
| 5,620,088 | A | 4/1997 | Martin et al. | |
| 5,685,420 | A | 11/1997 | Martin et al. | |
| 5,695,049 | A | 12/1997 | Bauman | |
| 5,697,495 | A * | 12/1997 | Abrams | B65D 77/0413 206/5.1 |
| 5,704,468 | A | 1/1998 | Lust et al. | |
| 6,044,966 | A | 4/2000 | Haase | |
| 6,260,695 | B1 | 7/2001 | Tasber et al. | |
| 6,398,018 | B1 | 6/2002 | Livesley et al. | |
| 6,471,052 | B2 | 10/2002 | Faxe et al. | |
| 6,474,465 | B1 | 11/2002 | Jux | |
| 6,572,165 | B2 | 6/2003 | Faxe et al. | |
| 6,889,825 | B2 | 5/2005 | Ichikawa et al. | |
| 6,997,344 | B2 | 2/2006 | Brown et al. | |
| 7,086,526 | B2 | 8/2006 | Newman | |
| 7,168,746 | B2 | 1/2007 | Py | |
| 7,426,993 | B2 | 9/2008 | Coldrey et al. | |
| 7,431,152 | B2 | 10/2008 | Marmo | |
| 7,477,366 | B2 | 1/2009 | Clements et al. | |
| 7,699,161 | B2 | 4/2010 | Tokarski et al. | |
| 7,770,732 | B2 | 8/2010 | Stroppolo et al. | |
| 7,784,608 | B2 | 8/2010 | Tokarski et al. | |
| 7,789,266 | B2 | 9/2010 | Biel et al. | |
| 7,816,455 | B2 | 10/2010 | Marmo | |
| 8,061,897 | B2 | 11/2011 | Ichikawa et al. | |
| 8,069,979 | B2 | 12/2011 | Newman et al. | |
| 8,281,920 | B2 | 10/2012 | Tokarski et al. | |
| 8,317,016 | B2 | 11/2012 | Tokarski et al. | |
| 8,459,445 | B2 | 6/2013 | Newman | |
| 8,833,548 | B2 | 9/2014 | Hsieh et al. | |
| 8,955,672 | B2 | 2/2015 | Newman | |
| 9,095,670 | B2 | 8/2015 | Briant et al. | |
| 9,119,450 | B2 | 9/2015 | Lee et al. | |
| 9,173,463 | B2 | 11/2015 | Clamp et al. | |
| 9,439,487 | B2 | 9/2016 | Barre et al. | |
| 9,655,423 | B1 | 5/2017 | Wang | |
| 9,701,458 | B2 | 7/2017 | Barrows et al. | |
| 9,839,270 | B2 | 12/2017 | Howell et al. | |
| D813,537 | S | 3/2018 | Miura et al. | |
| 10,092,075 | B2 | 10/2018 | Barre et al. | |
| 2006/0054514 | A1 | 3/2006 | Tokarski et al. | |
| 2006/0260957 | A1 | 11/2006 | Hamilton | |
| 2007/0119720 | A1 | 5/2007 | Marmo | |
| 2008/0047848 | A1 * | 2/2008 | Tokarski | B65D 75/366 206/5.1 |
| 2009/0139879 | A1 | 6/2009 | Tokarski et al. | |
| 2010/0300902 | A1 | 12/2010 | Marmo | |
| 2012/0055817 | A1 | 3/2012 | Newman et al. | |
| 2012/0267262 | A1 | 10/2012 | Wang et al. | |
| 2014/0001059 | A1 * | 1/2014 | Hsieh | A45C 11/046 206/5.1 |
| 2014/0246337 | A1 | 9/2014 | Newman | |
| 2014/0262845 | A1 | 9/2014 | Newman | |
| 2015/0114851 | A1 | 4/2015 | English et al. | |
| 2017/0086552 | A1 | 3/2017 | Michalos | |
| 2017/0096272 | A1 | 4/2017 | Coon et al. | |
| 2017/0165901 | A1 | 6/2017 | Fischer et al. | |
| 2018/0125189 | A1 | 5/2018 | Barre et al. | |
| 2019/0008251 | A1 | 1/2019 | Kim | |

FOREIGN PATENT DOCUMENTS

| | | | |
|---|---|---|---|
| JP | 2008253746 | A | 10/2008 |
| JP | 2012110592 | A | 6/2012 |
| JP | 5466344 | B1 | 4/2014 |
| JP | 5676760 | B2 | 2/2015 |
| JP | 2016221059 | A | 12/2016 |
| LU | 88593 | A1 | 9/1995 |
| WO | 2009102273 | A1 | 8/2009 |
| WO | 2011112998 | A2 | 9/2011 |
| WO | 2012131786 | A1 | 10/2012 |
| WO | 2012168964 | A1 | 12/2012 |
| WO | 2013136361 | A1 | 9/2013 |
| WO | 2013153582 | A1 | 10/2013 |
| WO | 2014195588 | A1 | 12/2014 |
| WO | 2017137738 | A1 | 8/2017 |

OTHER PUBLICATIONS

Examination Report issued in corresponding United Kingdom Patent Application No. GB2111870.8 dated Sep. 13, 2021 (6 pages).

* cited by examiner

PUSH-UP CONTACT LENS BLISTER PACKAGE

This application claims the benefit under 35 U.S.C. § 119(e) of prior U.S. Provisional Patent Application No. 62/795,302, filed Jan. 22, 2019, which is incorporated in its entirety by reference herein.

FIELD

The present invention relates to contact lens packaging and methods, and more specifically, to blister packages for sealed contact lenses containing unworn contact lenses, and methods of manufacturing contact lens packages.

BACKGROUND

Contact lenses, such as hydrogel and silicone hydrogel contact lenses, are frequently packaged in sealed blister packages or blister packs that permit storage of the unworn contact lenses in a sterile environment. For instance, a blister package which is adapted to provide a sterile sealed storage environment for a disposable or single-use hydrophilic contact lens, wherein the lens is immersed in a sterile aqueous solution, for example, such as in an isotonic saline solution, is described in Martinez, U.S. Pat. No. 4,691,820. Additional contact lens packages are disclosed in U.S. Pat. Nos. 4,691,820; 5,054,610; 5,337,888; 5,375,698; 5,409,104; 5,467,868; 5,515,964; 5,609,246; 5,620,088; 5,695,049; 5,697,495; 5,704,468; 5,711,416; 5,722,536; 5,573,108; 5,823,327; 5,704,468; 5,983,608; 6,029,808; 6,044,966; and 6,401,915.

As an example of part of a manufacturing process, a newly manufactured unworn contact lens will be placed in a cavity or bowl of a plastic base member of a contact lens blister package, a contact lens packaging solution will be provided in the blister package cavity, and a foil sealing member will be adhered to the blister package to hermetically seal the contact lens in the packaging solution in the cavity. In other words, a contact lens blister package used in the manufacture of contact lenses contains a base member having a cavity or bowl, an unworn contact lens provided in a packaging solution within the cavity, and a sealing member sealed to the base member to provide an air tight seal around the perimeter of the cavity. The sealed blister package containing the contact lens is then autoclaved to sterilize the contact lens in the packaging solution in the cavity. The blister packs are understood to be primary packaging. Multiple blister packs are then placed in cartons. The cartons are considered secondary packaging.

Contact lens packages typically require a user to place a finger in a cavity or bowl to pinch or otherwise manipulate the contact lens so it can be removed. The contact lens then needs to be positioned on a fingertip so it can be placed on an eye. Handling the contact lens, however, can introduce contaminants to the surface of the lens which can then be transferred to the eye. It can be appreciated that there remains a need to improve contact lens packaging, which, among other things, minimizes or eliminates the need for touching the contact lens before it is inserted onto a user's eye.

SUMMARY

The present invention addresses this need. As discussed herein, new contact lens packaging and methods of manufacturing packaged contact lenses are described. In general, as described herein, a contact lens package is provided. The contact lens package so described includes a plastic base member and a sealing member coupled to the base member to seal a contact lens in a cavity formed between the plastic base member and the sealing member. An unworn contact lens is provided in a contact lens packaging solution in the cavity. This sealed device is referred to herein as a sealed contact lens package or sealed contact lens blister package. The present contact lens package, when opened, presents the contact lens in an orientation and posture that enables direct transfer to a person's finger, facilitates the placement of the lens on a fingertip for easy transfer of the lens to the surface of the eye, or presents the contact lens in an orientation and posture that enables direct placement onto an eye. No digging into a cavity or bowl or pinching of a sterile lens is required to place the lens in a desired orientation for placement onto a fingertip or directly onto an eye. Moreover, the present contact lens package, when opened, presents the lens in an orientation that does not require any touching of the contact lens whatsoever in order for the lens to be placed onto the surface of an eye.

According to the present invention, a blister package for a contact lens is provided that comprises a body having a handle, a top surface, and a bowl recessed from the top surface. The bowl comprises a deformable sidewall configured such that, with finger pressure, a user can hold the handle and upwardly push-up the bowl into the shape of a dome whereby the contact lens in the bowl is presented for direct transfer to a person's finger or for application directly onto an eye. The blister package also comprises a seal that seals the top opening of the bowl prior to use. Upon peeling off the seal and pushing-up the bowl, the blister package provides a sterile contact lens ready for use.

The bowl has an outer bottom surface. The handle comprises a lateral portion and an end portion. The lateral portion of the handle extends laterally away from the bowl. The end portion of the handle is connected to the lateral portion and curves downwardly to a distal end. According to an exemplary embodiment, the distal end of the handle terminates at a plane and the outer bottom surface of the bowl rests on the same plane. As such, the blister package can be placed on a flat surface, remains sturdy on the flat surface, and can be opened and placed on a flat surface without spilling contact lens solution, in which the contact lens is immersed, from the bowl. Moreover, the handle enables a user to get a good grip on the blister package with one hand while pushing-up the deformable bowl with the other hand.

The deformable sidewall can comprise an elastically deformable material or an inelastically deformable material. In an exemplary embodiment, the deformable sidewall of the bowl comprises a double-wall structure including an inelastically deformable inner wall that maintains a dome shape once inverted, and an elastically deformable outer wall that rebounds to an original shape after deformation. Drainage through-holes can be provided between the inner wall and the outer wall such that, while the outer wall rebounds to its original position after inversion, a suction is created drawing contact lens solution from the inverted inner wall into the once-again-bowl-shaped outer wall. Thus, spillage of contact lens solution can be avoided or minimized.

The present invention also provides a method of opening a blister package as described herein. The blister package can comprise a body having a handle and a deformable bowl, and a seal. The deformable bowl can comprise a deformable sidewall configured such that, with finger pressure, a user can hold the handle and upwardly push-up the bowl into the shape of a dome. The method can involve pulling the seal to open the bowl at a top opening of the bowl and pushing an outer bottom surface of the bowl upwardly into the shape of a dome. In so doing, the contact lens that had been in a bowl is presented on top of a dome for direct transfer to a person's finger or for application directly onto an eye. The method can also include holding an end portion of the handle between a thumb and a finger of a first hand and pushing the outer bottom surface of the bowl upwardly and into the shape of a dome with a finger of a second hand. The method can involve holding only the end portion of the handle with a first hand while pushing the outer bottom surface of the bowl upwardly and into the shape of a dome with a finger of a second hand.

The blister package can comprise drainage features, for example, through-holes or a gutter for draining the bowl as the bowl is pushed-up into the shape of a dome, and the method can further comprise draining contact lens solution while, upon, or after inverting the bowl into the shape of a dome. The bowl can have a double-wall and the method can comprise draining contact lens solution into the space between the two walls, while, upon, or after inverting the bowl into the shape of a dome.

Other aspects and details of the present invention will be apparent based on the following drawings, detailed description, and claims.

DETAILED DESCRIPTION

Figure 1:
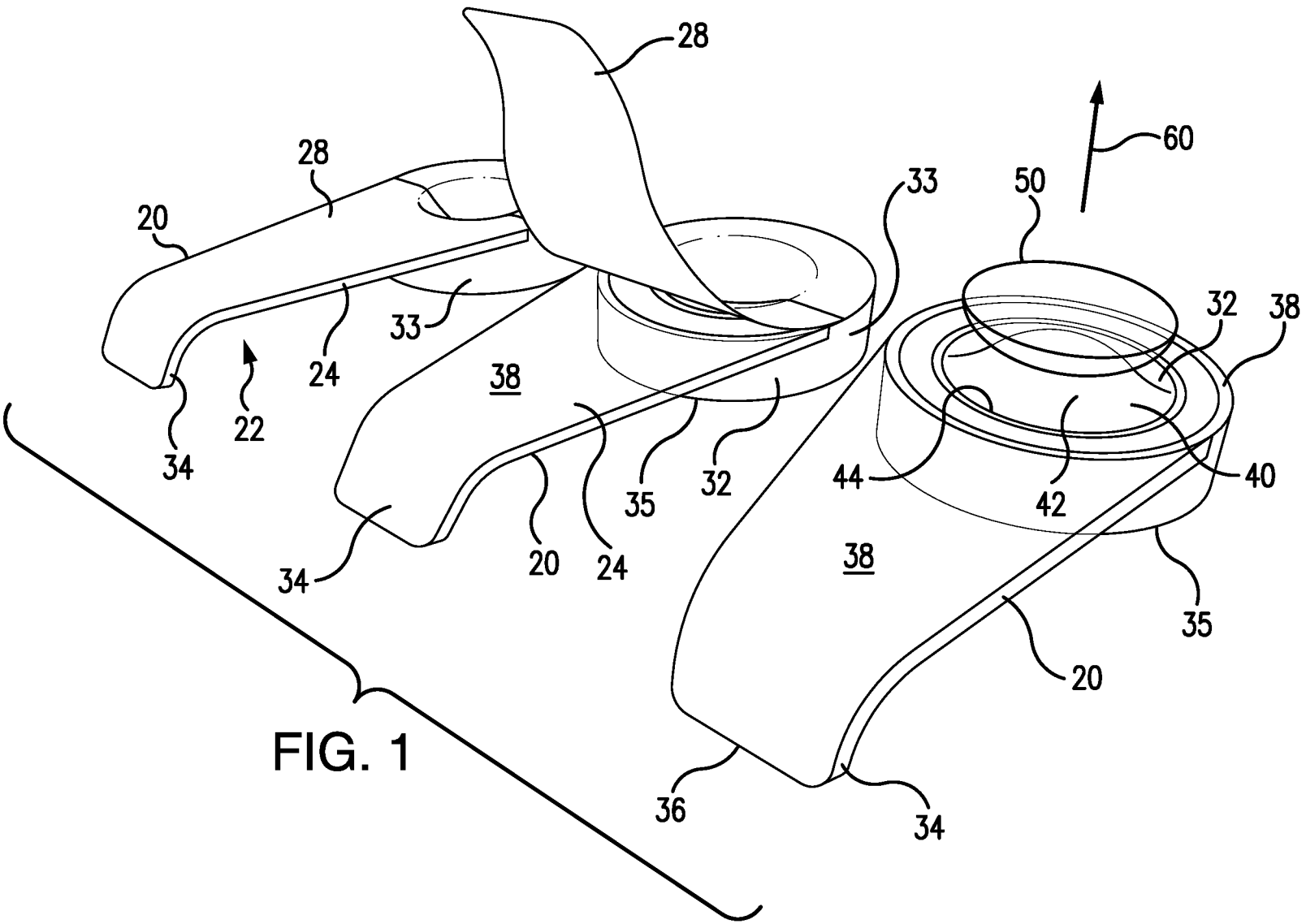
FIG. 1 shows a series of steps involved with opening a blister package and inverting a push-up bowl according to an embodiment of the present invention.

The present invention provides a blister package for a contact lens. The blister package comprises a body and a seal. The body comprises a handle and a bowl and has a body top surface. The bowl has a top opening and an outer bottom surface. The seal seals the bowl at the bowl top opening. The handle comprises a lateral portion and an end portion. The lateral portion extends laterally away from the bowl. The end portion is connected to the lateral portion and curves downwardly to a distal end. The distal end of the handle terminates at a plane. The bowl is recessed from the body top surface and the outer bottom surface of the bowl is arranged substantially on the plane. Thus, when resting on a flat surface, the outer bottom surface of the bowl and the distal end of the handle both rest on the same plane. The blister package has good stability and can be opened and set down without the packaged contact lens or contact lens solution spilling out of the bowl. The bowl comprises a deformable sidewall configured such that, with finger pressure, a user can hold the handle and upwardly push-up the bowl into the shape of a dome. Deformation of the bowl sidewall into an inverted orientation results in the formation of the dome.

The deformable sidewall can comprise an elastically deformable material but preferably comprises an inelastically deformable material so that, once inverted into the shape of a dome, the dome shape is maintained. The deformable sidewall can comprise a foil material, for example, a metal foil material such as an aluminum foil material. The deformable sidewall can comprise a plastic material, for example, a non-brittle polyalkylene material such as polypropylene or polyethylene.

The body top surface defines a bowl perimeter sealing surface. The seal can comprise a single layer foil material. The seal can comprise a double layer foil component comprising a sheet of material folded upon itself and defining a seal portion, a flap, and a fold. The double layer foil component can comprise a foil material, for example, a metal foil material such as aluminum foil. If a double layer material is used, the seal portion and the flap can intersect at the fold. The seal portion can contact the bowl perimeter sealing surface around the top opening of the bowl. The flap can be configured to be pulled away from the seal portion to form a pull tab, and the pull tab can be configured to be pulled so that the seal portion can be separated from the bowl perimeter sealing surface and the bowl can be opened. The seal portion has a shape and the flap can have a shape that mirrors the shape of the seal. The handle can comprise a top surface and the seal portion can be adhered to the body at the body top surface and along a portion of the top surface of the handle. The handle has a length and the fold can be disposed at a line along the handle and about midway along the length. The body of the blister package has a maximum width and the pull tab has a width that is equal to the maximum width.

The blister package can contain a contact lens within the bowl. The seal can comprise indicia thereon pertaining to a prescription of the contact lens. If a double layer material is used for the seal, as described above, the flap can comprise indicia thereon pertaining to a prescription of the contact lens.

The body can comprise a double wall of foil in an area defining the bowl. The material used for forming the bowl can be the same material, or a different material, relative to the material used to form the remainder of the body. Thus, the body and bowl can be integrally formed and of a one-piece, unitary construction, or can be fabricated separately and then connected together, as by adhesive, heat-bonding, or another bonding technique. For example, the bowl can have a perimeter flange, the body can be of double layer construction, and the flange of the bowl can be pinched between the two layers of the body around the perimeter of the bowl. The bowl has a depth, and a beach portion can be provided that intersects with the bowl. The beach can have a depth that is shallower than the depth of the bowl. The bowl perimeter sealing surface can surround a top opening of the bowl and the beach.

The present invention also provides an assembly comprising a plurality of blister packages, with each of the blister packages comprising a blister package with a deformable bowl, as described herein. Each blister package can have a bowl end and a handle end, and the blister packages can be alternately arranged such that, for each adjacent pair of blister packages, the bowl end of one blister package is arranged next to the handle end of the other blister package of the pair. As such, the assembly of blister packages can be efficiently packed in a multi-pack container.

The present invention also provides a method of opening a blister package, wherein the blister package comprises a body and a seal and the body comprises a deformable bowl.

The body can comprise both the deformable bowl and a handle. The body has a body top surface, a bowl top opening, and an outer bottom surface of the bowl. The seal can contact the body top surface and seal the bowl at the bowl top opening. The method can involve holding the handle and pulling the seal to open the bowl at the bowl top opening. The handle comprises a lateral portion and an end portion. The lateral portion extends laterally away from the bowl. The end portion is connected to the lateral portion and curves downwardly to a distal end, and the distal end of the handle terminates at a plane. The method also involves deforming the bowl while holding onto the handle. The bowl is recessed from the body top surface and the outer bottom surface of the bowl can be arranged substantially on the same plane at which the distal end of the handle terminates. The deformable sidewall of the bowl can be configured such that, with finger pressure, a user can hold the handle and upwardly push the bowl so that it is deformed and inverted into the shape of a dome. The handle can be held between a thumb and a finger of a first hand, and the outer bottom surface of the bowl can be pushed upwardly and into the shape of a dome with a finger of a second hand. With the contact lens presented on the dome of the bowl, a person may place the lens on a finger and then, with the finger, place the lens on the person's eye. Or, in some embodiments, once the bowl is inverted, the contact lens can be presented in a position that enables the entire opened blister package to be brought together with a user's eye in a manner such that the contact lens is transferred onto the eye without any need to touch the contact lens with a finger.

In practice, a user can hold the end portion of the handle by pinching the end portion between a thumb and a finger of a first hand, and then push the outer bottom surface of the bowl upwardly and into the shape of a dome with a finger of a second hand. By providing a stiffer or less deformable upper inner rim of the bowl, that does not get inverted, it can be possible to provide a blister package wherein only a portion of the bowl, and not the entire bowl, is inverted. In so doing, a gutter can be formed at the base of the dome to retain contact lens solution in which the contact lens had been immersed. Additionally, or alternatively, the blister package can comprise a drain for draining the bowl as the bowl is pushed-up into the shape of a dome, and the method can further comprise draining contact lens solution while inverting the bowl into the shape of a dome. For the purpose of drainage, a double layer bowl can be provided wherein the inner layer comprises an inelastically deformable material and the outer layer comprises an elastic deformable material that rebound to suck or draw contact lens solution through drainage holes to be caught by the outer bowl while the inner dome remains inelastically deformed in the shape of a dome. The elastic rebounding of the outer bowl layer can cause a suction to be formed as the outer layer returns to its original, non-deformed orientation. Drainage through-holes between the inner and outer layers can be provided to enable contact lens solution to be drawn into the outer bowl while the inner bowl remains inverted.

The blister package body includes a bowl for containing a contact lens immersed in an amount of a solution. The term "contact lens" as used herein is intended to embrace an ophthalmic lens shaped to be worn on the eye of an individual. The top surface of the body includes a peripherally located perimeter region at least partially surrounding an opening of the bowl. The handle can include a grip region. The flexible top is designed to cover and sealingly enclose the contact lens and solution within the bowl.

The body of the blister package can be formed of a plastic material that can be shaped by injection molding or thermoforming. The plastic material used to make the body can comprise polypropylene, polyethylene, polystyrene, or another thermoplastic material. One or more portions of the body material, particularly in the bowl, can have a vapor transmission of less than 10 grams/100 square inches/24 hours at 70° F. and 50 percent relative humidity.

As stated above, the body of the blister package can comprise a variety of structures, such as a relatively rigid material or a flexible material. The base member of the sealed blister package can be a thermoplastic material or injection molded material and the base member can include a bowl and a substantially planar body top surface surrounding the bowl. The substantially planar body top surface provides a sealing surface for sealing the flexible top. The body can be made from a variety of materials. The body can be formed using conventional methods and equipment, such as by injection molding polypropylene resin into body molds in an injection molding machine. The flexible top can also be formed from a variety of materials. For example, the flexible top can be a laminated structure comprising a foil and one or more layers of plastic, such as polypropylene and the like. The flexible top can include human readable information, as desired. The flexible top can be coupled to the body top surface by contacting the sealing surface of the body with the flexible top and applying heat to fuse the two members together to provide a hermetic or airtight seal for the contact lens and the packaging solution in the bowl.

The perimeter of the bowl can be contiguous with the circumference of the bowl. The perimeter can include a flange region, for example, extending about 5 mm from the opening of the bowl to a grip region. In an exemplary embodiment, the overall dimensions of the blister package can be approximately 30 mm wide, about 47 mm long and about 10 mm high. It should be appreciated, however, that the package can have any size and/or shape.

The bowl holds in a fluid tight manner, a contact lens and solution. The bowl is bounded by a seal area that is part of the flange region. The flexible top can be attached to the body by heat-sealing in the seal area; however, induction-sealing, sonic welding, or other bonding systems can be used to attach the flexible top to the body. The total interior volume defined by the bowl, once sealed, can be about 2.2 ml or less. The volume of packaging solution in the bowl can be, for example, from about 0.5 ml to about 2.5 ml.

The flexible top can comprise at least two elements, for example, at least two different, separate layers of material. For example, the flexible top can comprise a first member, or first layer, and a second member, or second layer overlaying the first member. The first member can be made of a laminate material that is heat sealed to the seal region of the blister package body. The second member can comprise a foil material, sealed to the rim portion of the body. The second member can comprise at least one, for example two, polymer layers, e.g. polypropylene, coating the foil. The foil can comprise aluminum. The polymer coating material on the heat seal side of the foil can be polypropylene. Examples of useful cover layers are described in U.S. Pat. No. 4,691,820 that is incorporated herein in its entirety by reference. The second member can be sealed to the body along an entire circumference of the body surrounding the bowl, so as to provide a sterile covering, for example, by means of a hermetic seal.

An unworn contact lens is sealed within the bowl of the sealed contact lens blister package and is packaged in a contact lens packaging solution. Any contact lens can be packaged therein. For example, the contact lens can be a hydrogel contact lens or it can be a silicone hydrogel contact lens. Examples of contact lenses that can be provided in the packages include those having the following United States Adopted Names (USANs): methafilcon A, ocufilcon A, ocufilcon B, ocufilcon C, ocufilcon D, omafilcon A, omafilcon B, comfilcon A, enfilcon A, stenfilcon A, etafilcon A, senofilcon A, senofilcon B, senofilcon C, narafilcon A, narafilcon B, balafilcon A, samfilcon A, lotrafilcon A, lotrafilcon B, somofilcon A, riofilcon A, delefilcon A, and the like.

The fluid medium or solution (i.e., the packaging solution) contained in the bowl can be any known solution useful for storing contact lenses including water, saline solutions, or buffered aqueous solutions. The contact lens and solution will preferably fill at least 50 percent, for example, at least 70 percent or at least 80 percent, of the total volume defined by the bowl once sealed by the flexible top. The contact lens packaging solution is typically a buffered saline solution, such as a phosphate buffered saline solution, or a borate buffered saline solution, that can contain one or more additives, such as surfactants, wetting agents, viscosity agents, and the like.

The blister package can also include a wrap that has one or more panels. The wrap can be dimensioned to accommodate the sealed contact lens package and to also provide a UDI in both human readable form and machine readable form, in addition to other required regulatory information. As used herein, a UDI is a "Unique Device Identifier". As used herein, a wrap refers to a substrate or article comprising one or more panels coupled to a sealed contact lens package, and a UDI in both human readable form and machine readable form is provided on at least one of the panels. Such a wrap can be understood to be a "UDI wrap", or it can be understood to be a wrap having a "UDI panel". Thus, the wrap includes human readable information, such as letters, numbers, and images; and the wrap includes machine readable information, such as bar codes and the like. The wrap can be flexible or rigid and does not need to fully enclose or surround the individual sealed contact lens package. The wrap is coupled to the sealed contact lens package so that the wrap and sealed contact lens package do not become separated until a person opens the package to remove the unworn contact lens. For example, the wrap can be adhered to the sealed contact lens package, such as by using an adhesive between a surface of the wrap and a surface of the sealing member, or the wrap can be physically wrapped around the sealed contact lens package to mechanically enclose the sealed contact lens package within the wrap. Thus, the wrap cannot be inadvertently dislodged or separated from the sealed contact lens blister package.

Examples of blister package materials, methods of making blister package bodies, flexible tops, methods of making flexible tops, methods of sealing flexible tops to bodies, as well as other helpful components, materials, methods, and systems are described, for example, in U.S. Pat. Nos. 6,398,018, 7,426,993 B2, and 7,477,366 B2, in U.S. Patent Application Publications Nos. US 2012/0061260 A1, and US 2017/0096272 A1, and in WO 2013/160667, each of which is incorporated herein in its entirety by reference.

With reference to the drawing figures, FIG. 1 illustrates the sequential steps involved with opening a blister pack 20 according to an exemplary embodiment of the present invention. FIG. 1 shows the same single blister pack 20 at three different points of time during an opening procedure. To the far left in FIG. 1 is a new, unopened, and unpeeled blister package 22. Blister package 22 comprises a body 24 and a flexible top 28 sealing a contact lens 50 within a well 32. Body 24 defines well 32 and a handle 34. In the third state, shown to the right, flexible top 28 has been completely removed from a top surface 38 of body 24 and is not seen.

With particular reference to the third state, shown to the right in FIG. 1, well 32 comprises a deformable sidewall 40 that, as shown, has been pushed-up from the bottom so as to be deformed and partially inverted into a dome 42 as shown. Deformable sidewall 40, as shown, comprises an inelastically deformable material such that it maintains the dome shape even in the absence of an applied pushing force, for example, applied by a fingertip. At the base of dome 42 is a gutter 44 having a depth equal to about 50% of the depth of well 32 before deformation of well 32. The depth of gutter 44 from top surface 38 surrounding bowl 32 can be of sufficient dimension to provide a sufficient volume for retaining all of the contact lens solution originally placed in bowl 32 with contact lens 50. Alternatively, the depth of gutter 44 from top surface 38 surrounding bowl 32 can be of sufficient dimension to provide a sufficient volume for retaining at least 50%, at least 60%, at least 70%, at least 80%, or at least 90% of the volume of contact lens solution originally placed in bowl 32 with contact lens 50.

Handle 34 includes a distal end 36 having a bottom surface that terminates at a plane. Outer sidewall 33 of well 32 has a flat bottom including a bottom edge 35 that lies on the same plane as that on which lies the bottom of distal end 36 of handle 34.

As best illustrated by the state shown to the far right in FIG. 1, contact lens 50 is lifted above top surface 38 of body 24, supported by dome 42, and presented in an orientation facilitating placement on a finger or, alternatively, direct placement onto an eye without any need whatsoever to touch contact lens 50 with a fingertip. It is to be understood that, although the state shown to the far right includes a directional arrow 60 pointing upwardly, the state shown to the far right shows the blister package in a fully pushed-up configuration such that further upward movement is neither needed nor recommended to position contact lens 50 in position for transfer. Thus, directional arrow can be considered to show the direction in which the sidewall of bowl 32 had been pushed to achieve the inverted state shown. While it is possible that deformable sidewall 40 of bowl 32 can be pushed up even further, deformable sidewall 40 can be provided with thicker or otherwise stiffer material near the top of the sidewall to increase resistance to deformation and practically limit inversion of bowl 32 into the shape of dome 42.

Figure 2B:
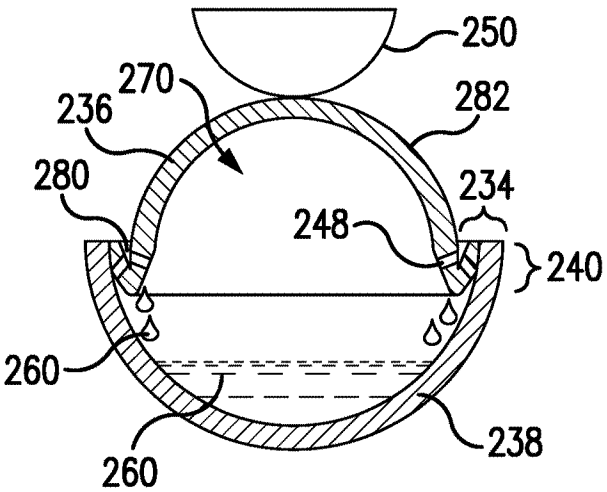
FIGS. 2A and 2B are cross-sectional views showing a double-wall deformable sidewall in accordance with an embodiment of the present invention, before and after inverting the deformable sidewall to form a dome.
Figure 2A:
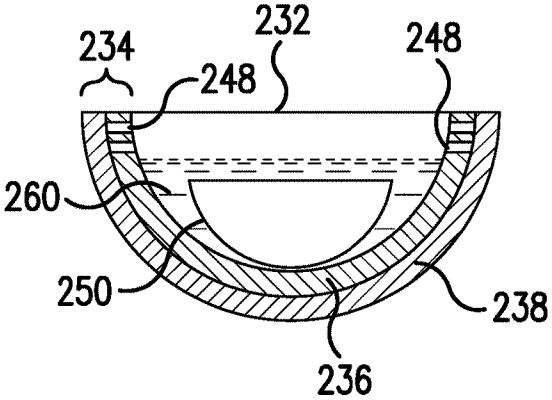

FIG. 2A is a cross-sectional view of a bowl 232 having a double-wall deformable sidewall 234 in accordance with an embodiment of the present invention, before inverting deformable sidewall 234 to form a dome. FIG. 2B is a cross-sectional view of the same bowl 232 and same double-wall deformable sidewall 234 shown in FIG. 2A but after inverting deformable sidewall 234 to form a dome. Details of the remainder of the blister package body have been omitted for the sake of clarity, and the flexible top of the blister package has been completely removed and discarded such that it is not seen. As seen in FIG. 2A, double-wall deformable sidewall 234 comprises an inelastically deformable inner wall 236 and an elastically deformable outer wall 238. Inelastically deformable inner wall 236 and an elastically deformable outer wall 238 are not adhered or otherwise bonded together except at an upper portion 240 of the deformable sidewall. As seen in FIG. 2A, there is no discernable gap between inelastically deformable inner wall 236 and an elastically deformable outer wall 238, before deformation. Before use, a contact lens 250 and contact lens solution 260 are disposed in bowl 232, as shown in FIG. 2A, and the top of bowl 232 is sealed by a flexible top (not shown). A plurality of drainage through-holes 248 are formed through inelastically deformable inner wall 236. Once bowl 232 is opened, as shown, double-wall deformable sidewall 234 can be pushed upwardly, as by a fingertip, deforming both inelastically deformable inner wall 236 and an elastically deformable outer wall 238 into the shape of a double-wall dome, but upon removing the force caused by the fingertip, inelastically deformable inner wall 236 retains its dome shape due to the inelastic nature of the material. On the other hand, elastically deformable outer wall 238 rebounds due to the elastic nature of the material and goes back to its original bowl shape as shown in FIG. 2B. The rebounding action of elastically deformable outer wall 238 cause a vacuum inside a space 270 newly formed between inelastically deformable inner wall 236 and an elastically deformable outer wall 238 and the vacuum draws in contact lens solution 260, through drainage through-holes 248, including contact lens solution that accumulates in a gutter 280 formed at a crease in the outer surface 282 of inelastically deformable inner wall 236, formed by deformation of inelastically deformable inner wall 236.

Figure 3:
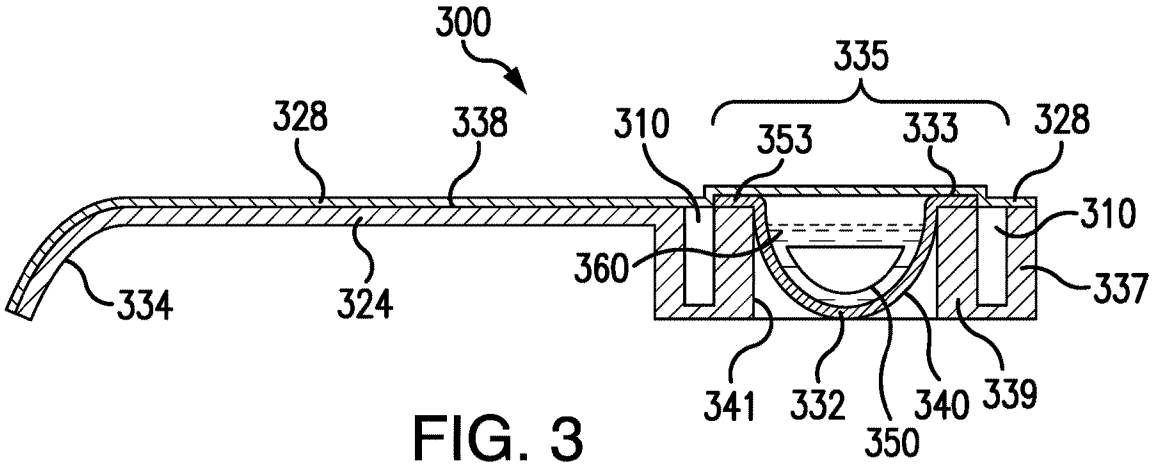
FIG. 3 is a cross-sectional view of a contact lens blister package according to another embodiment of the present invention and including a drainage moat surrounding a push-up lens bowl having a deformable sidewall.

FIG. 3 is a cross-sectional view of a contact lens blister package according to another embodiment of the present invention. Blister package 300 includes a moat 310 surrounding a push-up bowl 332 that has a deformable sidewall 340. Push-up bowl 332 retains a contact lens 350 and contact lens solution 360. Push-up bowl 332 and is sealed at a top surface 333 of a flange 353 of push-up bowl 332. Top surface 333 is sealed by a flexible top 328 adhered or otherwise also bonded to a top surface 338 of a blister package body 324. Body 324 defines a handle 334 and a bowl assembly 335. Bowl assembly 335 comprises and defines an outer assembly sidewall 337, moat 310, an inner assembly sidewall 339, and a push-through through-hole 341. Outer assembly sidewall 337 and an inner assembly sidewall 339 can be integrally formed with body 324, as of one-piece, monolithic construction.

As can be discerned from FIG. 3, when flexible top 328 is peeled away from top surface 338 of body 324, for example, from the handle toward the bowl assembly, bowl assembly 335 is exposed. Push-up bowl 332 can be pushed-up through through-hole 341 to render contact lens 350 on top of a newly formed dome and ready for application to a finger or to an eye. As push-up bowl 332 is pushed up, contact lens solution 360 runs down the peaking dome and drains into moat 310 that catches the contact lens solution. The volume of moat 310 can be at least as big as the volume of contact lens solution disposed in blister package 300, for example, 10% greater, 20% greater, 30% greater, or more. Moat 310 is configured to catch contact lens solution 360 and prevent spillage and overflow of contact lens solution. A hydrophobic coating material can be coated onto top surfaces of outer assembly sidewall 337 and inner assembly sidewall 339, and hydrophilic coating material can be coated onto the surfaces of moat 310, so as to pull the aqueous contact lens solution into moat 310 and prevent wetting of outer assembly sidewall 337 and an inner assembly sidewall 339.

The present invention includes the following aspects/embodiments/features in any order and/or in any combination:

1. A blister package for a contact lens, the blister package comprising a body and a seal, the body comprising a handle and a bowl, the body having a body top surface, a bowl top opening, and an outer bottom surface of the bowl, the seal sealing the bowl at the bowl top opening, wherein the handle comprises a lateral portion and an end portion, the lateral portion extends laterally away from the bowl, the end portion is connected to the lateral portion and curves downwardly to a distal end, and the distal end of the handle terminates at a plane, and the bowl is recessed from the body top surface, the outer bottom surface of the bowl is arranged substantially on the plane, the bowl comprises a deformable sidewall, and the deformable sidewall is configured such that, with finger pressure, a user can hold the handle and upwardly push-up the bowl into the shape of a dome.
2. The blister package of any preceding or following embodiment/feature/aspect, wherein the deformable sidewall comprises an elastically deformable material.
3. The blister package of any preceding or following embodiment/feature/aspect, wherein the deformable sidewall comprises an inelastically deformable material.
4. The blister package any preceding or following embodiment/feature/aspect, wherein the deformable sidewall comprises a foil.
5. The blister package of any preceding or following embodiment/feature/aspect, wherein the body top surface defines a bowl perimeter sealing surface, and the seal comprises a double layer foil component comprising a sheet of material folded upon itself and defining a seal portion, a flap, and a fold, the seal portion and the flap intersecting at the fold, wherein the seal portion contacts the bowl perimeter sealing surface around the top opening of the bowl, the flap is configured to be pulled away from the seal portion to form a pull tab, and the pull tab is configured to be pulled so that the seal portion can be separated from the bowl perimeter sealing surface and the bowl can be opened.
6. The blister package of any preceding or following embodiment/feature/aspect, wherein the seal portion has a shape and the flap has a shape that mirrors the shape of the seal.
7. The blister package of any preceding or following embodiment/feature/aspect, wherein the double layer foil component comprises aluminum foil.
8. The blister package of any preceding or following embodiment/feature/aspect, wherein the handle comprises a top surface and the seal portion is adhered to the body at the body top surface and along a portion of the top surface of the handle.
9. The blister package of any preceding or following embodiment/feature/aspect, wherein the handle has a length and the fold is disposed at a line along the handle and about midway along the length.
10. The blister package of any preceding or following embodiment/feature/aspect, wherein the bowl contains a contact lens, and the flap comprises indicia thereon pertaining to a prescription of the contact lens.
11. The blister package of any preceding or following embodiment/feature/aspect, wherein the body has a maximum width and the pull tab has a width that is equal to the maximum width.
12. The blister package of any preceding or following embodiment/feature/aspect, wherein the body comprises a double wall of foil in an area defining the bowl.
13. The blister package of any preceding or following embodiment/feature/aspect, wherein the bowl has a depth, a beach is provided that intersects with the bowl, the beach has a depth that is shallower than the depth of the bowl, and the bowl perimeter sealing surface surrounds a top opening of the bowl and the beach.

14. The blister package of any preceding or following embodiment/feature/aspect, wherein the bowl comprises a double-wall structure including an inelastically deformable inner wall that maintains a dome shape once inverted, and an elastically deformable outer wall that elastically rebounds to an original bowl shape after deformation, drainage through-holes are formed through the inelastically deformable inner wall, and the blister package is configured such that, after inversion, as the elastically deformable outer wall rebounds to its original position after inversion, a suction is created drawing contact lens solution from the inverted inner wall through the drainage through-holes and into a bowl formed from the once-again-bowl-shaped outer wall.

15. An assembly comprising a plurality of blister packages, each blister package comprising a blister package of any preceding or following embodiment/feature/aspect, wherein each blister package has a bowl end and a handle end, and the blister packages are alternately arranged such that, for each adjacent pair of blister packages, the bowl end of one blister package is arranged next to the handle end of the other blister package of the pair.

16. A method of opening a blister package, the blister package comprising a body and a seal, the body comprising a handle and a bowl, the body having a body top surface, a bowl top opening, and an outer bottom surface of the bowl, the seal sealing the bowl at the bowl top opening, wherein the handle comprises a lateral portion and an end portion, the lateral portion extends laterally away from the bowl, the end portion is connected to the lateral portion and curves downwardly to a distal end, and the distal end of the handle terminates at a plane, the bowl is recessed from the body top surface, the outer bottom surface of the bowl is arranged substantially on the plane, the bowl comprises a deformable sidewall, and the deformable sidewall is configured such that, with finger pressure, a user can hold the handle and upwardly push-up the bowl into the shape of a dome, and the method comprises:

pulling the seal to open the bowl at the bowl top opening; and pushing the outer bottom surface of the bowl upwardly and into the shape of a dome.

17. The method of any preceding or following embodiment/feature/aspect, further comprising holding the end portion of the handle between a thumb and a finger of a first hand, wherein the pushing the outer bottom surface of the bowl upwardly and into the shape of a dome comprises pushing with a finger of a second hand.

18. The method of any preceding or following embodiment/feature/aspect, further comprising holding only the end portion of the handle by pinching between a thumb and a finger of a first hand, wherein the pushing the outer bottom surface of the bowl upwardly and into the shape of a dome comprises pushing with a finger of a second hand.

19. The method of any preceding or following embodiment/feature/aspect, wherein the blister package comprises a drain for draining the bowl as the bowl is pushed-up into the shape of a dome, and the method further comprises draining contact lens solution while inverting the bowl into the shape of a dome.

The present invention can include any combination of these various features or embodiments above and/or below as set-forth in sentences and/or paragraphs. Any combination of disclosed features herein is considered part of the present invention and no limitation is intended with respect to combinable features.

The entire contents of all references cited in this disclosure are incorporated herein in their entireties, by reference. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether such ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof

What is claimed is:

1. A blister package for a contact lens, the blister package comprising a body and a seal, the body comprising a handle and a bowl, the body having a body top surface, a bowl top opening, and an outer bottom surface of the bowl, the seal sealing the bowl at the bowl top opening, wherein the handle comprises a lateral portion and an end portion, the lateral portion extends laterally away from the bowl, the end portion is connected to the lateral portion and curves downwardly to a distal end, and the distal end of the handle terminates at a plane, and the bowl is recessed from the body top surface, the outer bottom surface of the bowl is arranged substantially on the plane, the bowl comprises a deformable sidewall, the deformable sidewall is configured such that, with finger pressure, a user can hold the handle and upwardly push-up the bowl into the shape of a dome, and the deformable sidewall comprises a double-wall structure including an inelastically deformable inner wall that maintains the shape of the dome once inverted, and an elastically deformable outer wall that elastically rebounds to an original bowl shape after deformation.

2. The blister package of claim 1, wherein the deformable sidewall comprises a foil.

3. The blister package of claim 1, wherein the body top surface defines a bowl perimeter sealing surface, and the seal comprises a sheet of material defining a seal portion and a flap, wherein the seal portion contacts the bowl perimeter sealing surface around the top opening of the bowl, the flap is configured to form a pull tab, and the pull tab is configured to be pulled so that the seal portion can be separated from the bowl perimeter sealing surface and the bowl can be opened.

4. The blister package of claim 3, wherein the seal portion has a shape and the flap has a shape that mirrors the shape of the seal.

5. The blister package of claim 3, wherein the seal comprises aluminum foil.

6. The blister package of claim 3, wherein the handle comprises a top surface and the seal portion is adhered to the body at the body top surface and along a portion of the top surface of the handle.

7. The blister package of claim 3, wherein the body has a maximum width and the pull tab has a width that is equal to the maximum width.

8. The blister package of claim 1, wherein the bowl contains a contact lens, and the flap comprises indicia thereon pertaining to a prescription of the contact lens.

9. The blister package of claim 1, wherein drainage through-holes are formed through the inelastically deformable inner wall, and the blister package is configured such that, after inversion, as the elastically deformable outer wall rebounds to its original position after inversion, a suction is created drawing contact lens solution from the inverted inner wall through the drainage through-holes and into a bowl formed from the once-again-bowl-shaped outer wall.

10. An assembly comprising a plurality of blister packages, each blister package comprising a blister package of claim 1, wherein each blister package has a bowl end and a handle end, and the blister packages are alternately arranged such that, for each adjacent pair of blister packages, the bowl end of one blister package is arranged next to the handle end of the other blister package of the pair.

11. A method of opening a blister package for a contact lens, the blister package comprising a body and a seal, the body comprising a handle and a bowl, the body having a body top surface, a bowl top opening, and an outer bottom surface of the bowl, the seal sealing the bowl at the bowl top opening, wherein the handle comprises a lateral portion and an end portion, the lateral portion extends laterally away from the bowl, the end portion is connected to the lateral portion and curves downwardly to a distal end, and the distal end of the handle terminates at a plane, and the bowl is recessed from the body top surface, the outer bottom surface of the bowl is arranged substantially on the plane, the bowl comprises a deformable sidewall, the deformable sidewall is configured such that, with finger pressure, a user can hold the handle and upwardly push-up the bowl into the shape of a dome, and the deformable sidewall comprises a double-wall structure including an inelastically deformable inner wall that maintains the shope of the dome once inverted and an elastically deformable outer wall that elastically rebounds to an original bowl shape after deformation, and the method comprises:

pulling the seal to open the bowl at the howl top opening; and pushing the outer bottom surface of the bowl upwardly and into the shape of a dome.

12. The method of claim 11, further comprising holding the end portion of the handle between a thumb and a finger of a first hand, wherein the pushing the outer bottom surface of the bowl upwardly and into the shape of a dome comprises pushing with a finger of a second hand.

13. The method of claim 11, further comprising holding only the end portion of the handle by pinching between a thumb and a finger of a first hand, wherein the pushing the outer bottom surface of the bowl upwardly and into the shape of a dome comprises pushing with a finger of a second hand.

14. The method of claim 11, wherein the blister package comprises a drain for draining the bowl as the bowl is pushed-up into the shape of a dome, and the method further comprises draining contact lens solution while inverting the bowl into the shape of a dome.

* * * * *